US008734297B2

(12) United States Patent
Chen

(10) Patent No.: US 8,734,297 B2
(45) Date of Patent: May 27, 2014

(54) FLASH SPINNER TRAMPOLINE

(76) Inventor: Samuel Chen, Shanghai (CN)

( * ) Notice: Subject to any disclaimer, the term of this patent is extended or adjusted under 35 U.S.C. 154(b) by 168 days.

(21) Appl. No.: 13/588,916

(22) Filed: Aug. 17, 2012

(65) Prior Publication Data

US 2014/0051550 A1 Feb. 20, 2014

(51) Int. Cl.
*A63B 5/11* (2006.01)

(52) U.S. Cl.
USPC ..... 482/27

(58) Field of Classification Search
USPC ..... 482/23, 26–29; 472/105, 135; 446/236, 446/242
See application file for complete search history.

(56) References Cited

U.S. PATENT DOCUMENTS 3,853,191 A * 12/1974 Yamagiwa ..... 177/210 R
4,489,933 A * 12/1984 Fisher et al. ..... 482/28
4,709,307 A * 11/1987 Branom ..... 362/103
5,190,491 A * 3/1993 Connelly ..... 446/242
7,297,089 B2 * 11/2007 Chen ..... 482/27
7,572,206 B2 * 8/2009 Wilkins et al. ..... 482/8
8,371,991 B2 * 2/2013 Chen ..... 482/27
8,585,558 B2 * 11/2013 Chen ..... 482/27
2004/0058787 A1 * 3/2004 Lin ..... 482/84
2005/0043122 A1 * 2/2005 Publicover et al. ..... 473/465
2006/0135320 A1 * 6/2006 Chen ..... 482/27
2006/0135321 A1 * 6/2006 Chen ..... 482/27
2011/0034300 A1 * 2/2011 Hall ..... 482/1
2012/0302407 A1 * 11/2012 Kelliher ..... 482/45
2013/0072269 A1 * 3/2013 Chen ..... 463/7

* cited by examiner

*Primary Examiner* — Loan H Thanh
*Assistant Examiner* — Garrett Atkinson
(74) *Attorney, Agent, or Firm* — Clement Cheng

(57) ABSTRACT

A trampoline has a bed. The bed is made of a sheet of fabric having an exterior periphery. A frame includes legs supporting the frame from the ground. A plurality of springs attach the bed to the frame. A light sound module is suspended under the bed. The light sound module includes a light emitting element mounted on a rotation rod. The rotation rod is mounted on a rotation axis, and the rotation rod is driven to rotate by a motor. A plurality of elastic cords has a length, namely a first elastic cord, a second elastic cord, and a third elastic cord.

19 Claims, 10 Drawing Sheets

FLASH SPINNER TRAMPOLINE

FIELD OF THE INVENTION

The present invention is in the field of trampoline accessories.

DISCUSSION OF RELATED ART

With development in industry and commerce and improved lifestyle, people are paying more attention to exercise. People need varying levels of physical activities and a variety of different types of sports to match these different needs. The progress has led to developing varying sorts of both exercise types and fitness equipments. The backyard trampoline has become more popular recently for body conditioning. It is said that the trampoline can train one's jumping ability and also improve one's power, balance, and reaction.

A typical trampoline frame is round or rectangular. The trampoline support mostly relies on the bottom of the frame to support the frame above the ground. There is a first bed side which is formed as a net or mesh having an outside face that provides upward restoring force on the surface of the net. When force is applied downward, the surface of the net restores to a neutral position to rebound the mesh bed. Springs connecting the bed to the trampoline frame provide restoring force. Thus, users can bounce on the face of the net for a jumping movement exercise.

Besides providing a rebound surface, the traditional trampoline provides no other feature. Unfortunately, sometimes users become bored with the traditional trampoline leading to dangerous and unsafe activity. Sometimes users discontinue use of the trampoline. It is desired to have an improvement upon the traditional trampoline.

Over time, inventors have improved the traditional trampoline. In United States Patent Publication 2005/0227812, of Oct. 13, 2005 in inventor James describes a trampoline mat and method of making the trampoline. This is an improved trampoline mat is capable of being attached to a trampoline frame using a plurality of coil springs. A variety of structural improvements have been added to the traditional trampoline over time.

Inventor Samuel Chen improved the trampoline United States Patent Publication 2006/0135321 of Jun. 22, 2006 by providing a lighted trampoline, the disclosure of which is incorporated herein by reference.

SUMMARY OF THE INVENTION

A trampoline has a bed. The bed is made of a sheet of fabric having an exterior periphery. A frame includes legs supporting the frame from the ground. A plurality of springs attach the bed to the frame. A light sound module is suspended under the bed. The light sound module includes a light emitting element mounted on a rotation rod. The rotation rod is mounted on a rotation axis, and the rotation rod is driven to rotate by a motor. A plurality of elastic cords has a length, namely a first elastic cord, a second elastic cord, and a third elastic cord.

The first elastic cord has a first elastic cord inside end connected to the light sound module. The second elastic cord has a second elastic cord inside end connected to the light sound module. The third elastic cord has a third elastic cord inside end connected to the light sound module. The first elastic cord has a first elastic cord outside end connected to either the bed or frame. The first elastic cord has a first elastic cord outside end connected to either the bed or the exterior periphery. The second elastic cord has a second elastic cord outside end connected to either the bed or the exterior periphery. The third elastic cord has a third elastic cord outside end connected to either the bed or the exterior periphery.

A plurality of buckle hooks includes a first buckle hook attached to the first elastic cord outside end, a second buckle hook attached to the second elastic cord outside end, and a third buckle hook attached to the third elastic cord outside end. The trampoline may also have a fourth elastic cord having a fourth elastic cord inside end attached to the light sound module, and having a fourth elastic cord outside end connected to either the bed or the exterior periphery.

A first adjustment buckle is attached to the first elastic cord inside end, and the first adjustment buckle adjusts the length of the first elastic cord. A second adjustment buckle is attached to the second elastic cord inside end. The second adjustment buckle adjusts the length of the second elastic cord. The third adjustment buckle is attached to the third elastic cord inside end, and the third adjustment buckle adjusts the length of the third elastic cord.

The light emitting element of the light sound module includes a first LED element at a first radius and a second LED element at a second radius. As the first LED element spins and as the second LED element spins, the first LED element can draw a circle having a first radius and the second LED element can draw a circle having a second radius. The first radius is closer than the second radius to the rotation axis. The first radius can be called the inside radius and the second radius can be called the outside radius. Additional light emitting elements can be linearly disposed on the rotation arm. The rotation arm can be a flexible or rigid printed circuit.

The present invention of a flash spinner is a more sophisticated improvement on the prior art. This invention incorporates a lighted trampoline having a frame, a bounce member and a bounce sensor, sensing bounces to activate lights and provide sounds for entertaining and training purposes. The present invention uses the bouncing movement of the user to activate a sound and light module on a trampoline to provide safety and entertainment to trampoline users.

The present invention provides a trampoline with entertaining sound and light effects including: a frame, a net, an elastic component, a light device, and frame legs. The bottom of the frame has the legs that primarily supports the frame. The bed is mounted to the frame by a set number of springs, also known as elastic components such as helical springs. The bed is is bounded within the frame to form a margin and a bed surface edge. The light device is fixed underneath the bed to be contacted by a user when a user jumps on the bed.

The electrical circuit board at the bottom of the box set is connected to a transparent superstructure. An electric circuit board is connected to vibration sensors. A light and sound emitting unit is powered by a power supply unit that can be a battery box or household electric current. The box set has a peripheral edge with rope holes for receiving a number of elastic rope connections at one end. The elastic rope other end connects to frame. A fixed sound light device vibration trigger can be a spring and pole vibration switch mounted to achieve conduction actuation. The vibration switch is typically soldered to the circuit board to control the light emitting unit. The light-emitting unit of the central box set bottom has a combination of a rotating rod with light emitting elements such as LED's mounted in an array on the rotating rod. The rotating rod is set on the motor shaft. The LED's can be mounted at an angle other than a normal angle. The angular difference can provide a greater field of display. For example, the LEDs can be mounted at a 45° angle to the plane of the rotating rod.

The sound and light device circuit board connection is used to issue music, voice and sound on mounted speakers. To provide additional adjustability, one end of the elastic rope can be connected to an adjustment buckle with the other end of the connection being a button hook.

A sound element is mounted to an electronic circuit housed within the light sound module, and the electronic circuit is actuated by a vibration sensor preferably soldered on the electronic circuit board. The rotation rod can be a printed circuit formed as a strip.

An object of the invention is to allow the user to activate a sound and light device under the mesh bed while the user bounces on the trampoline. The device includes an automatic sensor in the form of the vibration switch that enhances trampoline fun and safety with flashing sound and spinning lights.

Figure 1:
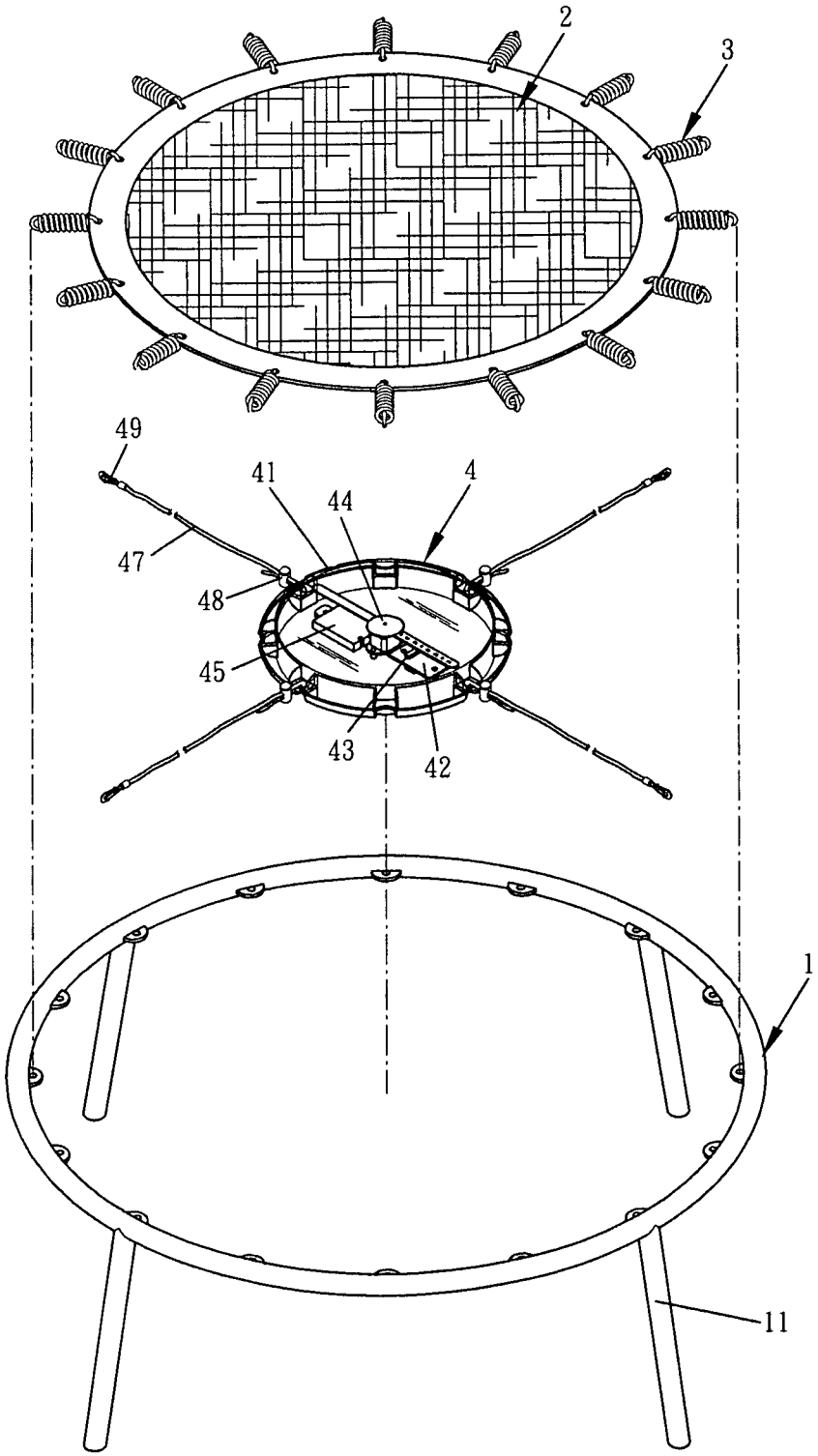
FIG. 1 is an exploded view of the trampoline.
Figure 2:
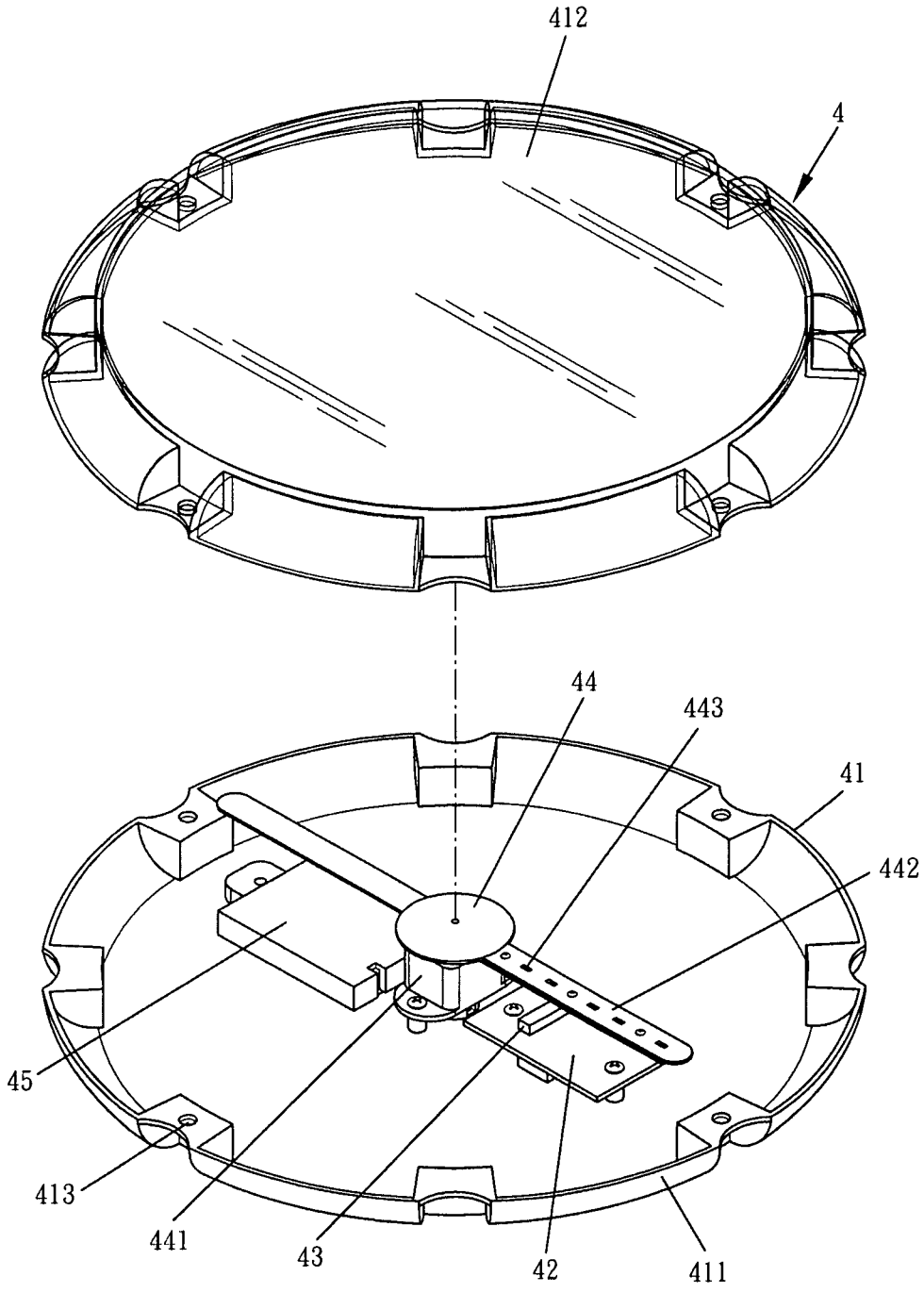
FIG. 2 is an exploded view of the creation of sound and light device stereo.
Figure 3:
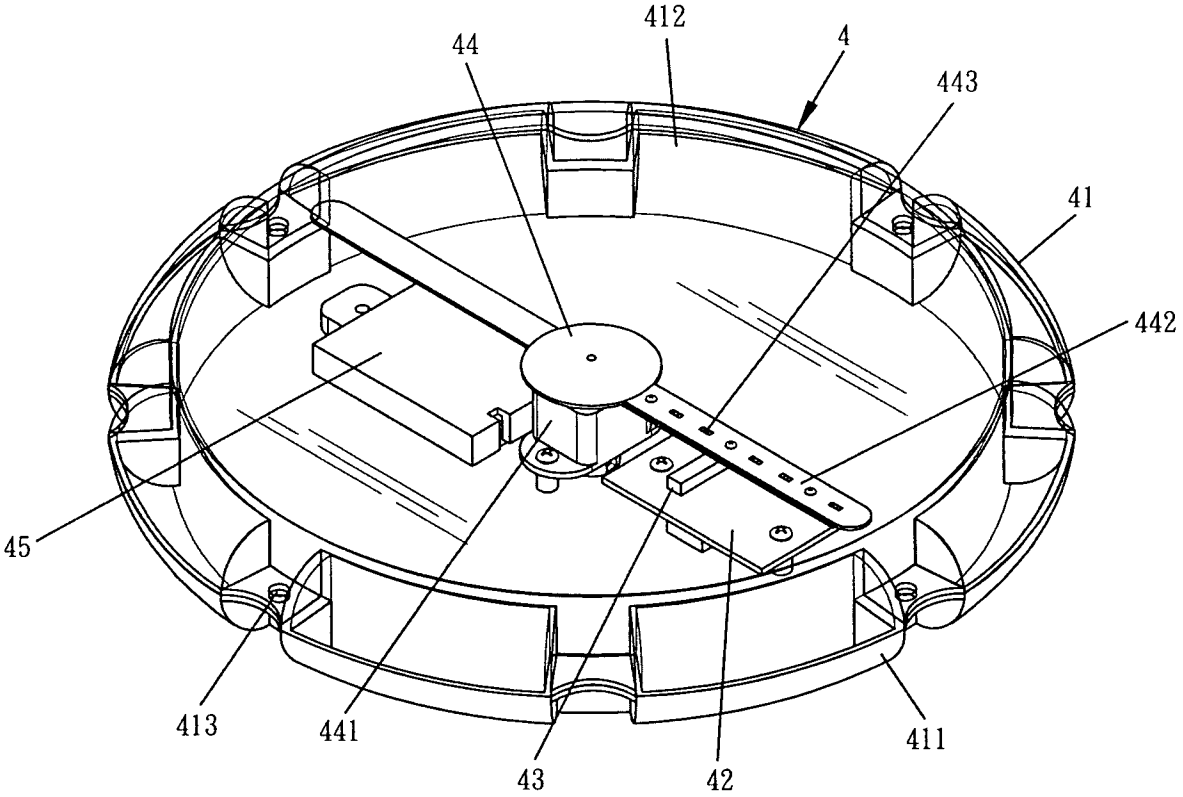
FIG. 3 is a perspective view of the sound and light module.
Figure 4:
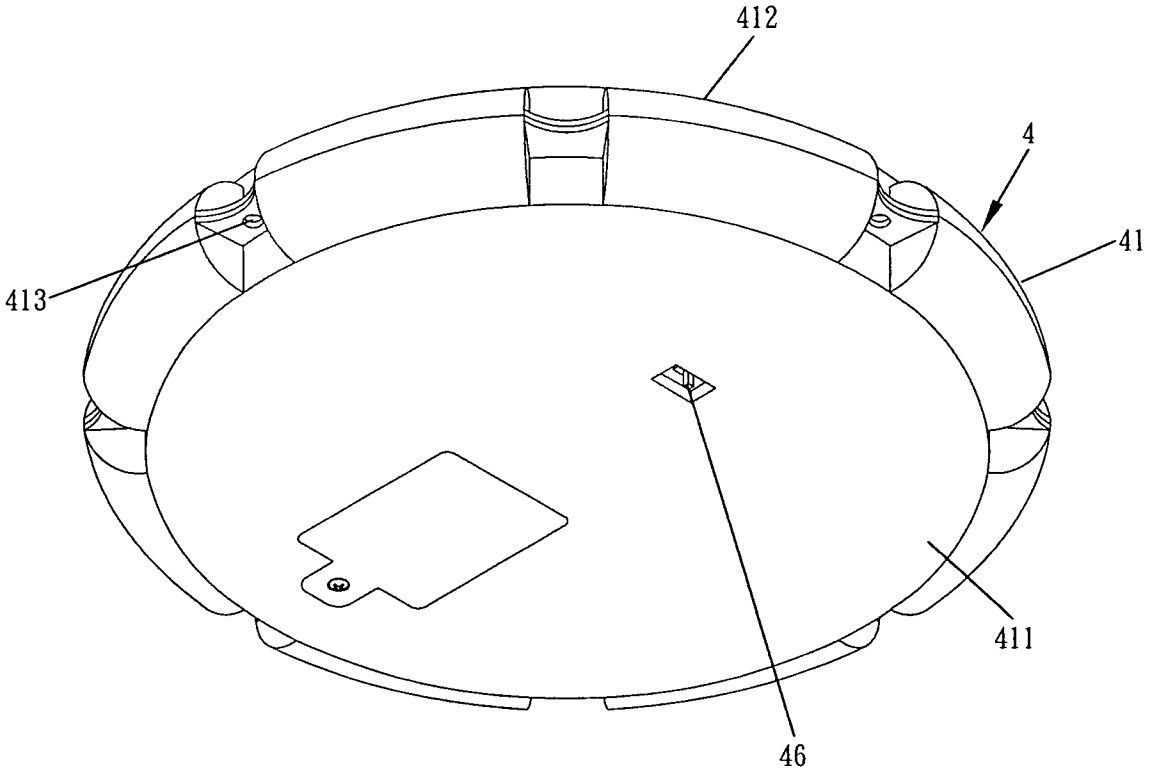
FIG. 4 is a bottom view of the sound and light module.
Figure 5:
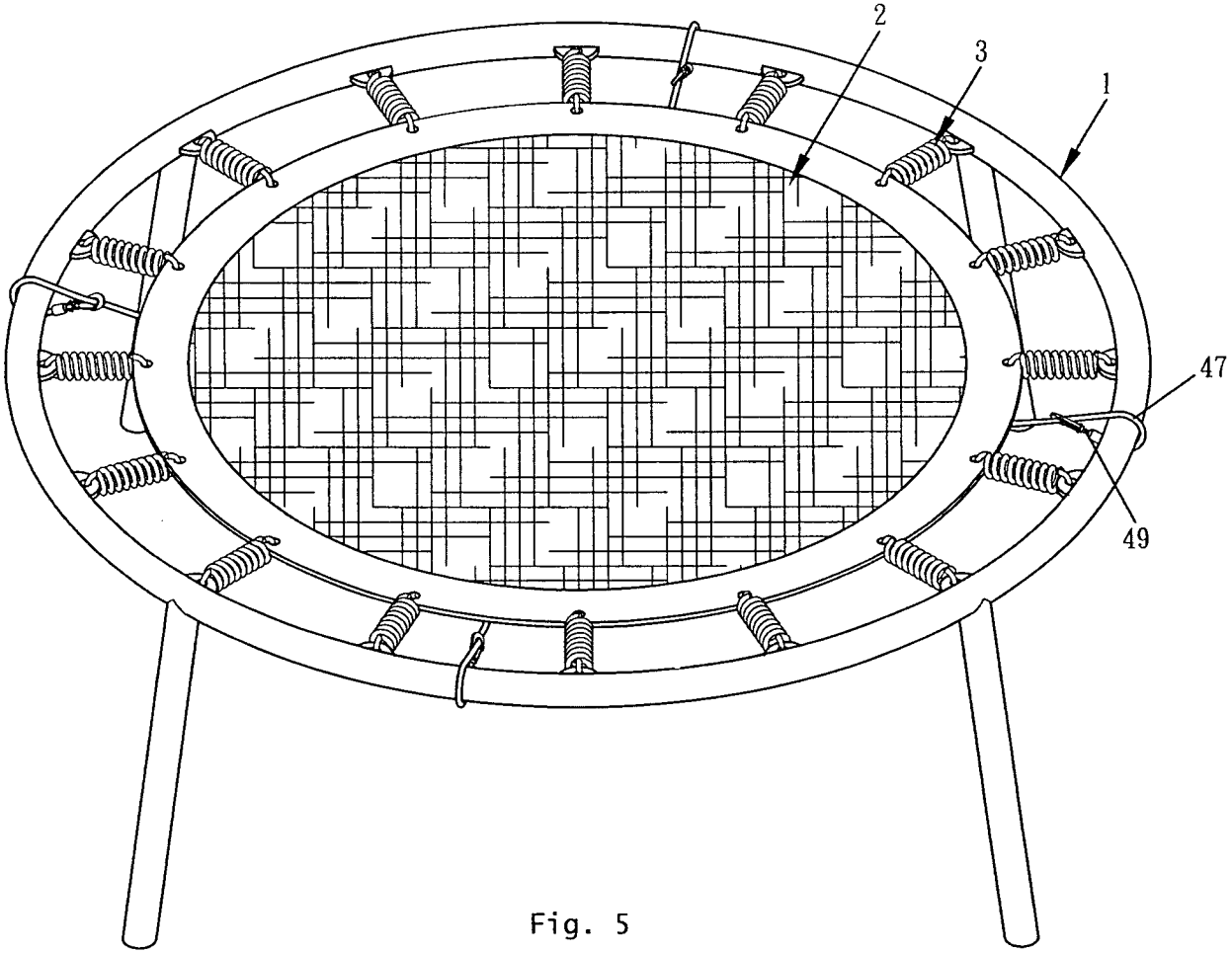
FIG. 5 is a diagram of the attachment of the sound and light module to the trampoline.
Figure 6:
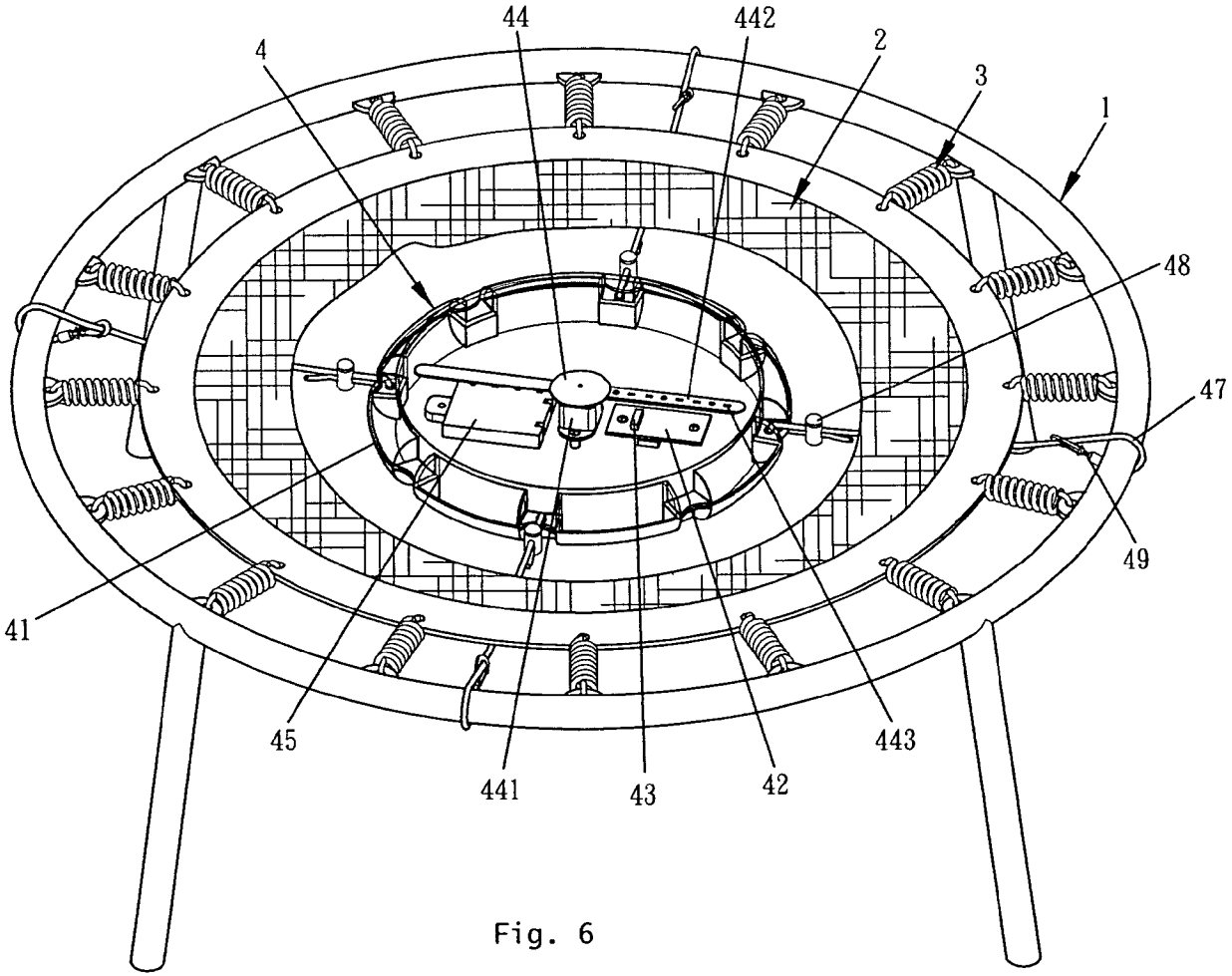
FIG. 6 is a cutaway view of the attachment of the light and sound module to the trampoline.
Figure 7:
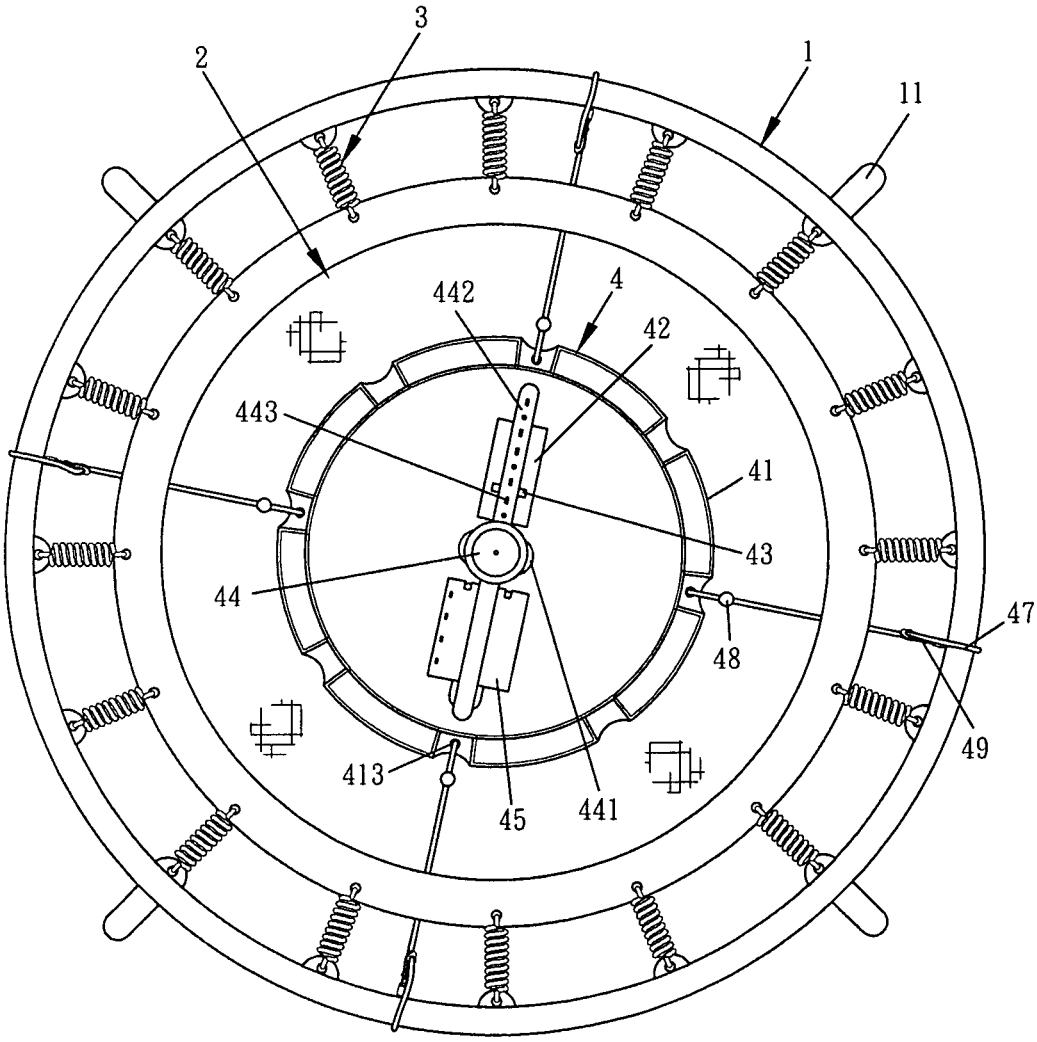
FIG. 7 is a top sectional view of the attachment of the light and sound module to the trampoline.
Figure 8:
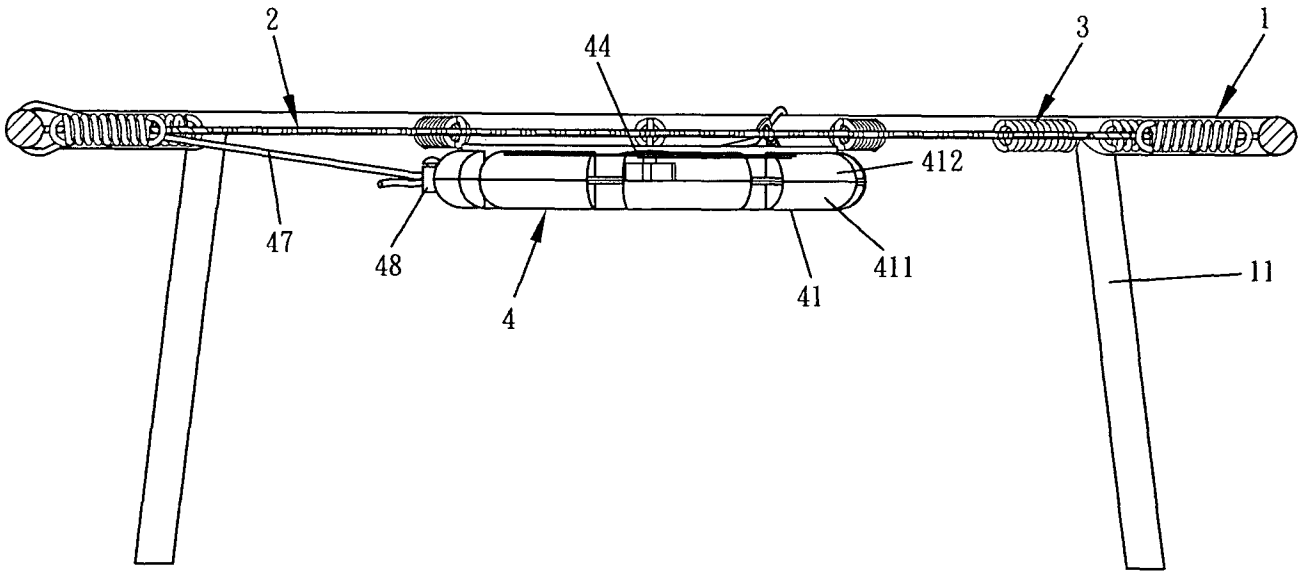
FIG. 8 is a trampoline side view.
Figure 9:
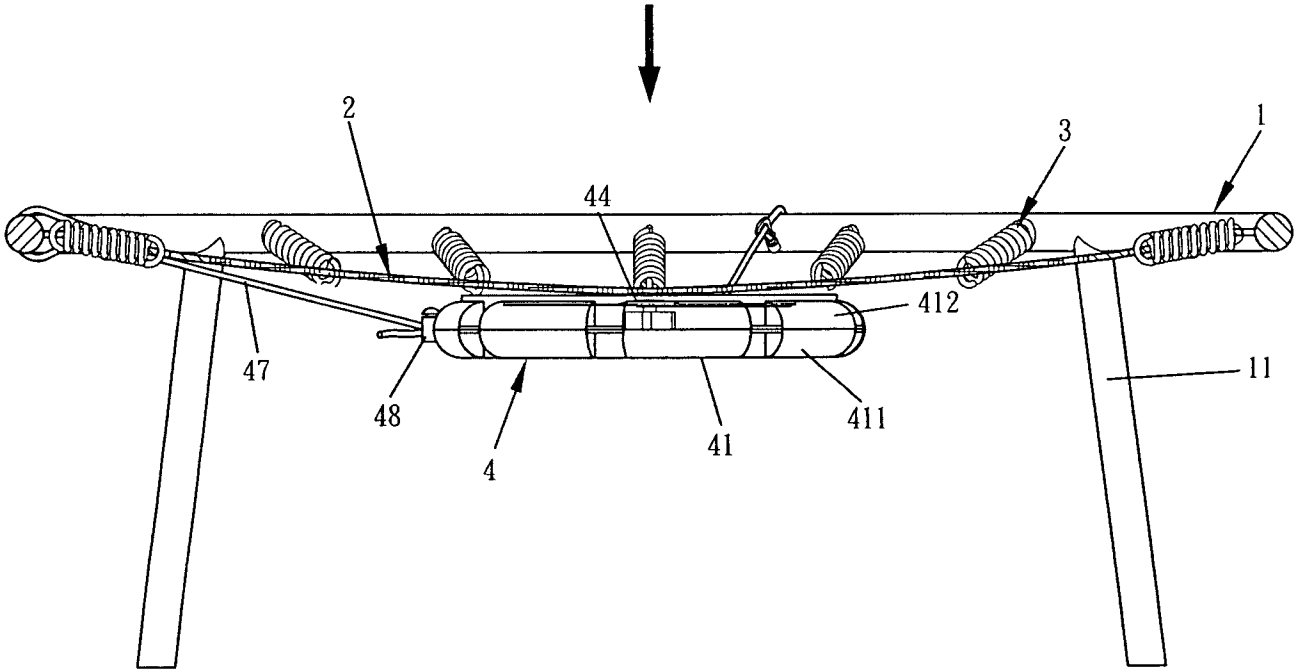
FIG. 9 is a trampoline bouncing action diagram.

The following call out list of elements can be used as a guide in referencing the elements of the drawings.

1 Frame
11 Supporting leg
2 Bed
3 Spring
4 Sound Light Device
41 Capacity Set Box
411 bottom of the box
42 Circuit Boards
43 Vibration Sensors
44 Light-Emitting Unit
45 Power Supply Unit
47 Elastic Rope
48 Adjustment Buckle
49 Buckle Hook
412 Transparent Superstructure
413 Rope Holes
441 Motor
442 Rotation Rod
443 Light-emitting Element

DETAILED DESCRIPTION OF THE PREFERRED EMBODIMENT

The present invention provides the structure of the trampoline with sound and light effects for entertainment. The invention includes: a frame 1, a net 2, an elastic component 3, and sound light device 4, where the bottom of the frame features a majority of the supporting leg 11. The mesh in the frame contains a set number of elastic components connected at set intervals between the frame 1, margin, and net surface edge. The light device is set at the bottom of the bed 2 that be formed as a net or made of a mesh. The frame 1 has a bed supporting portion and supporting legs. The bed supporting portion has connections for receiving springs 3. Springs are elastic elements that can be made of metal or fiberglass or even plastic elements. The elastic elements can also be called elastic components.

The sound light device is preferably made as a plastic box that can be round. The plastic box may have an upper transparent superstructure 412 which acts as a lens that fits over a capacity set box 41 that acts as a main housing for the sound light device. The electrical circuit board 42 at the bottom of the capacity set box 41 is connected to a transparent superstructure that can be snapped into place over the capacity set box 41. The upper transparent superstructure 412 is preferably made of an impact resistant plastic that is soft enough not to crack when jumped upon.

Electric circuit boards 42 are connected to the vibration sensors 43 such that the vibration sensors are part of the electric circuit of the electric circuit boards. The electric circuit boards are preferably printed circuit boards with component soldered on the printed circuit boards.

A light-emitting unit 44 includes a power supply unit 45 to power the lights and speakers of the light emitting unit 44. The electric circuit board 42 is connected to the driver of the speaker. The driver of the speaker can be a rectangular element mounted facing downward on an underside of the electric circuit board 42. The electric circuit board 42 can be mounted on a pair of mounting posts with openings disposed on the printed circuit board for allowing a pair of screws to secure the openings to the mounting posts. The driver of the speaker is preferably soldered to the printed circuit board and facing downward. The driver of the speaker emanates sound initially downward which vibrates the capacity set box. The sound then transmits to the transparent superstructure such that the transparent superstructure and the capacity set box become a speaker for transmitting sound vibrations through the air to the user. The bottom surface of the capacity set box 41 can be open with a plurality of openings to allow sound to travel to the user.

The light-emitting unit 44 may include a set of assembled components including the motor 441, formed as a bottom box mounted to a top surface of the capacity set box on a pair of mounting posts. Preferably, the shaft of the motor directly connects without gearing to a rotation rod 442. The rotation rod 442 can be flexible and also can be a printed circuit. The rotation rod 442 can also be a printed circuit board in a rigid form.

The rotation rod 442 is formed as a rotating lever and preferably has a counterbalance which can also be lighted. A plurality of light-emitting elements 443 such as a light-emitting diode (LED) can be mounted to a top or bottom surface of the rotation rod 442. When the light emitting unit 44 is activated, it plays sound to the speaker which can be a discrete element mounted to a bottom side of the circuit board 42 or the speaker can be the entire housing of the sound light device 4. When the light emitting unit 44 is activated, the motor 441 spins and rotates the rotation rod 442. The rotation rod 442 as a plurality of light emitting elements that can display a message, display a sequence, or display a light design.

The power supply unit 45 is a battery box. The battery box preferably has a screw for preventing young children from accessing and swallowing the batteries. The power switch 46 pierces the bottom of the box 411 and is accessible from the bottom of the box. The capacity set box 41 peripheral edge has rope holes 413 for a number of elastic rope 47 to connect at an inside end. The adjustment buckle 48 can be used for adjusting a length of elastic cord. The adjustment buckle 48 can be installed toward the inside end of the elastic cord.

The elastic rope 47 connects at an outside end to the frame. When the light sound device receives vibration, it activates. A buckle hook 49 facilitates triggering conduction of vibrations. The circuit board may have a processor to control the light emitting unit. The frame receives a buckle hook mounted on the elastic cord 47. Alternatively, the buckle hook can be attached to the springs or the external periphery of the bed.

Figure 10:
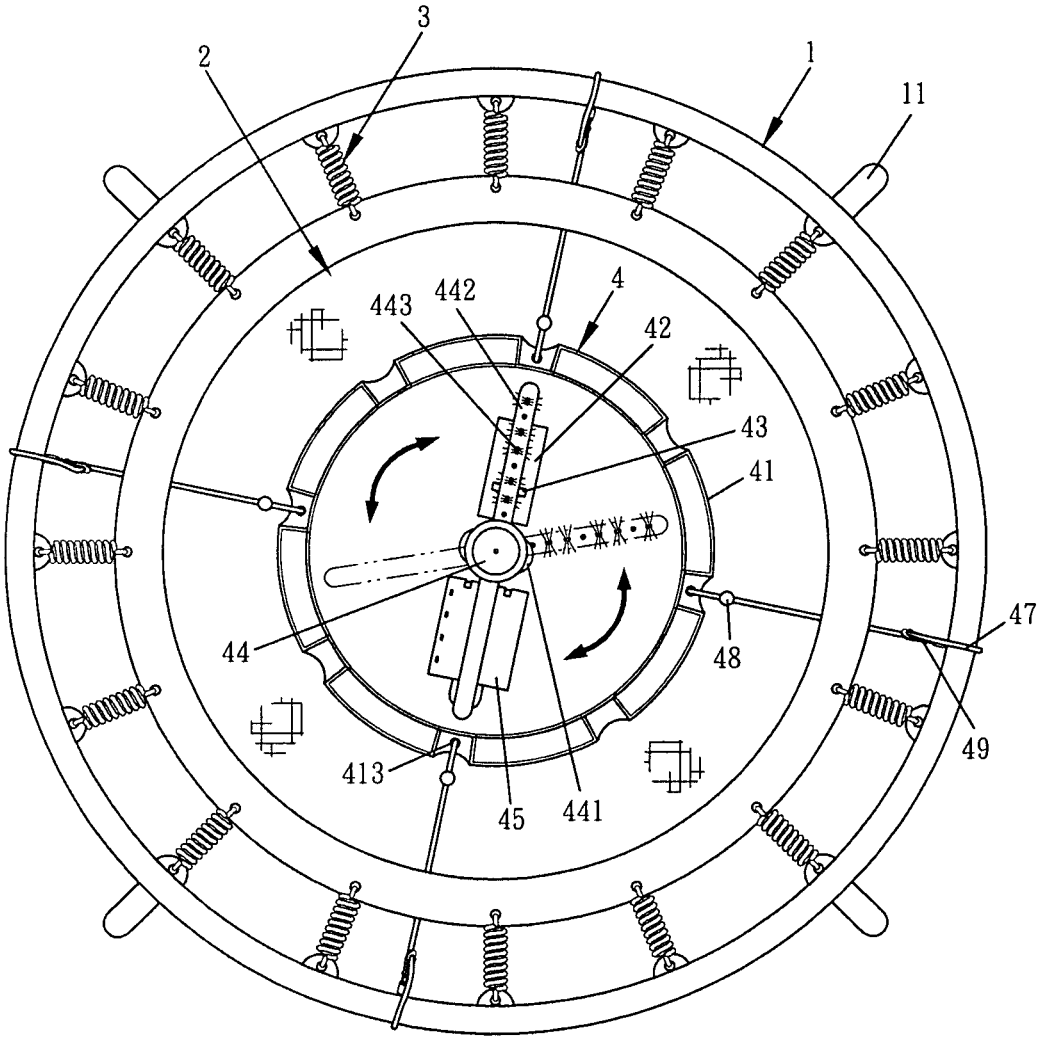
FIG. 10 is a trampoline spinning light diagram.

When assembled according to FIG. 10, the user will stand atop the bed 2 to jump. The mechanical operation is similar to traditional trampoline operation. When the user exerts force on the the bed, the bed 2 will subside in the direction of the force. This will produce a change in the springs 3, so that original condition of the bed 2 will be restored by the springs 3. The recovery of the bed rebounds the user upward.

Each time force is exerted on the bed 2, the bed 2 will subside below the location of the sound light device 4 of the capacity set box 41. As a result, the elastic rope 47 will pull and stretch, which will cause the elastic rope 47 to pull the capacity set box 41 back to its original condition. The impact of the bed on the sound light device sound light device 4 causes vibrations that trigger vibration sensors 43 to activate by closing circuit on the electric circuit board 42. The electric circuit board controls the light-emitting unit 44 for moving the light-emitting unit and for activating other sound devices.

The light-emitting unit 44 of the motor 441 drives the rotation rod 442. While the rotation rod 442 spins, the light-emitting element 443 flickers. This illumination can be intermittent or continuous, and dazzling lighting effects can form around the ring of the trampoline. In addition, the sound light device power switch 46 turns off the device. This allows for the lighting and sound effect to be terminated at the user's discretion.

The present invention preferably provides a trampoline having both sound and light entertainment simultaneously in addition to the bouncing movement. Moreover, in combination with the under bed 2 sound light device 4, the light-emitting unit 44 preferably provides a spinning motion to the lights, and also affecting the sound to further enhance the fun factor of the trampoline.

The above is the preferred embodiment. It should be pointed out that a person of ordinary skill in the art can further make improvements and polish these improvements without departing from the original scope of the claims. Alterations to the specification can be made within the scope of the claims. For example, the brightness of the lights may be adjusted according to the trampoline bed fabric mesh so that the lights are visible to the user through the trampoline bed.

The invention claimed is:

1. A trampoline comprising:

a. a bed, wherein the bed is made of a sheet of fabric having an exterior periphery;

b. a frame having legs supporting the frame from the ground;

c. a plurality of springs attaching the bed to the frame;

d. a light sound module suspended under the bed, wherein the light sound module includes a light emitting element mounted on a rotation rod, wherein the rotation rod is mounted on a rotation axis, wherein the rotation rod is driven to rotate by a motor;

e. a plurality of elastic cords having a length, wherein the plurality of elastic cords comprises: a first elastic cord, a second elastic cord, and a third elastic cord; wherein each elastic cord comprises an inside end and an outside end; and wherein the plurality of elastic cords suspend the light sound module under the bed.

2. The trampoline of claim 1, further comprising: a plurality of buckle hooks, wherein the plurality of buckle hooks comprises: a first buckle hook attached to the first elastic cord outside end, a second buckle hook attached to the second elastic cord outside end, and a third buckle hook attached to the third elastic cord outside end.

3. The trampoline of claim 2, further comprising: a first adjustment buckle attached to the first elastic cord inside end, wherein the first adjustment buckle adjusts the length of the first elastic cord; and a second adjustment buckle attached to the second elastic cord inside end, wherein the second adjustment buckle adjusts the length of the second elastic cord; and a third adjustment buckle attached to the third elastic cord inside end, wherein the third adjustment buckle adjusts the length of the third elastic cord.

4. The trampoline of claim 2, wherein the light emitting element of the light sound module includes a first LED element at a first radius and a second LED element at a second radius, wherein the first radius is closer than the second radius to the rotation axis.

5. The trampoline of claim 2, wherein the rotation rod is a printed circuit.

6. The trampoline of claim 1, further comprising: a fourth elastic cord having an inside end and an outside end.

7. The trampoline of claim 1, further comprising: a first adjustment buckle attached to the first elastic cord inside end, wherein the first adjustment buckle adjusts the length of the first elastic cord; and a second adjustment buckle attached to the second elastic cord inside end, wherein the second adjustment buckle adjusts the length of the second elastic cord; and a third adjustment buckle attached to the third elastic cord inside end, wherein the third adjustment buckle adjusts the length of the third elastic cord.

8. The trampoline of claim 1, wherein the light emitting element of the light sound module includes a first LED element at a first radius and a second LED element at a second radius, wherein the first radius is closer than the second radius to the rotation axis.

9. The trampoline of claim 1, wherein the rotation rod is a printed circuit.

10. The trampoline of claim 1, further comprising: a plurality of buckle hooks, wherein the plurality of buckle hooks comprises: a first buckle hook attached to the first elastic cord outside end, a second buckle hook attached to the second elastic cord outside end, and a third buckle hook attached to the third elastic cord outside end; and further comprising: an inside end and an outside end.

11. The trampoline of claim 10, further comprising: a first adjustment buckle attached to the first elastic cord inside end, wherein the first adjustment buckle adjusts the length of the first elastic cord; and a second adjustment buckle attached to the second elastic cord inside end, wherein the second adjustment buckle adjusts the length of the second elastic cord; and a third adjustment buckle attached to the third elastic cord inside end, wherein the third adjustment buckle adjusts the length of the third elastic cord.

12. The trampoline of claim 10, wherein the light emitting element of the light sound module includes a first LED element at a first radius and a second LED element at a second radius, wherein the first radius is closer than the second radius to the rotation axis.

13. The trampoline of claim 10, wherein the rotation rod is a printed circuit.

14. The trampoline of claim 1, further comprising: a sound element mounted to an electronic circuit housed within the light sound module, wherein the electronic circuit is actuated by a vibration sensor.

15. The trampoline of claim 14, further comprising: a plurality of buckle hooks, wherein the plurality of buckle hooks comprises: a first buckle hook attached to the first elastic cord outside end, a second buckle hook attached to the second elastic cord outside end, and a third buckle hook attached to the third elastic cord outside end.

16. The trampoline of claim 14, further comprising: a fourth elastic cord having an inside end and an outside end.

17. The trampoline of claim 14, further comprising: a first adjustment buckle attached to the first elastic cord inside end, wherein the first adjustment buckle adjusts the length of the first elastic cord; and a second adjustment buckle attached to the second elastic cord inside end, wherein the second adjustment buckle adjusts the length of the second elastic cord; and a third adjustment buckle attached to the third elastic cord inside end, wherein the third adjustment buckle adjusts the length of the third elastic cord.

18. The trampoline of claim 14, wherein the light emitting element of the light sound module includes a first LED element at a first radius and a second LED element at a second radius, wherein the first radius is closer than the second radius to the rotation axis.

19. The trampoline of claim 14, wherein the rotation rod is a printed circuit formed as a strip.

* * * * *